US005462839A

United States Patent [19]

de Rooij et al.

[11] Patent Number: 5,462,839

[45] Date of Patent: Oct. 31, 1995

[54] PROCESS FOR THE MANUFACTURE OF A MICROMACHINED DEVICE TO CONTAIN OR CONVEY A FLUID

[75] Inventors: Nicolaas Frans de Rooij, Bôle; Sylvain Jeanneret, La Chaux-de-Fonds; Volker Gass; Bart van der Schoot, both of Neuchâtel, all of Switzerland

[73] Assignee: Universite de Neuchatel, Neuchatel, Switzerland

[21] Appl. No.: 247,550

[22] Filed: May 23, 1994

[30] Foreign Application Priority Data

May 24, 1993 [FR] France ..... 93 06281

[51] Int. Cl.[6] ..... F04B 43/00

[52] U.S. Cl. ..... 430/320; 417/413.1

[58] Field of Search ..... 430/320, 313; 437/171, 228, 213, 239; 156/274.4; 417/413.1, 413.2, 413.3

[56] References Cited

U.S. PATENT DOCUMENTS

| | | | |
|---|---|---|---|
| 4,938,742 | 7/1990 | Smits | 604/67 |
| 5,171,132 | 12/1992 | Miyazaki et al. | 417/413 |
| 5,219,278 | 6/1993 | Van Lintel | 417/413 R |
| 5,259,737 | 11/1993 | Kamisuki et al. | 417/322 |

FOREIGN PATENT DOCUMENTS 465229 1/1992 European Pat. Off. .

WO9015929 12/1990 WIPO .

OTHER PUBLICATIONS

Abstract of JP 59–29461, "Manufacture of Semiconductor Device", Ueda (Feb. 1984).

Sensors and Actuators, vol. 20, No. ½, Nov. 1, 1989, Lausanne CH, pp. 163–169.

Sensors and Actuators, vol. 32, No. ⅓, Apr. 1, 1992, Lausanne CH, pp. 335–339.

*Primary Examiner*—Richard L. Schilling
*Assistant Examiner*—John A. McPherson
*Attorney, Agent, or Firm*—Sughrue, Mion, Zinn, Macpeak & Seas

[57] ABSTRACT

This process consists of machining a silicon piece (4) by means of selective oxidation operations and photolithography to form therein at least one cavity (7, 12) adapted to contain or convey a fluid, and of oxidizing the wall of the cavity to make this hydrophilic. The device is completed by fixing closing plates (1, 5) to its body thus formed. Prior to the machining operations the surfaces of the piece (4) adapted to be in contact with the closing plates (1, 5) are covered with a screening layer that resists these machining operations. Then, after these have been completed, the surfaces of the piece intended to be exposed to the fluid are oxidized to form therein an oxide layer favoring the wettability of these surfaces. The screening layer is then removed and the closing plates are fixed to the piece.

The invention has applications, notably in micropumps.

3 Claims, 4 Drawing Sheets

PROCESS FOR THE MANUFACTURE OF A MICROMACHINED DEVICE TO CONTAIN OR CONVEY A FLUID

FIELD OF THE INVENTION

The instant invention relates to a process for the manufacture of devices produced by micromachining silicon and adapted to contain or to convey gaseous or liquid fluids. More specifically, the invention relates to the manufacture of micropumps made of silicon produced using photolithographic machining techniques.

DESCRIPTION OF THE PRIOR ART

A particular design of a silicon micropump excited by a piezo-electric element is disclosed in patent application PCT-WO 91/07591. This specification also cites problems connected with the fact that silicon is a hydrophobic material resulting in the fact that silicon surfaces in contact with the fluid to be pumped are of moderate wettability. This problem is all the more acute since this type of micropump is often used to convey medicaments presented in the form of aqueous solution. Under these conditions, and without taking special precautions, it is impossible to correctly fill the pumping chamber and/or the chambers of the inlet and outlet valves.

The solution to this problem raised in the above-mentioned international patent application, namely rendering the surfaces in contact with the fluid to be conveyed hydrophilic, consists in oxidizing the silicon pump body after its manufacture so as to form a very thin superficial layer of silicon oxide which, for its part, is hydrophilic and can thus considerably improve the wettability of the volumes of the pump in contact with the fluid to be conveyed. More specifically, the above-mentioned document proposes dipping the completed pump body in boiling nitric acid for a sufficient period of time to create a suitable thickness of the hydrophilic layer.

This procedure does, however, have the disadvantage that, in oxidizing the pump body in this manner, the entire silicon surface exposed undergoes the treatment, including the surfaces on which the cover glasses of the pump will subsequently be welded.

It is, however, known that it is difficult or impossible to weld glass to a silicon oxide surface.

The presence of the oxide layer covering the silicon exposed to the fluid does, however, remain desirable since it also has another advantage in that it makes it possible to protect the silicon from attack by the fluid, assuming, of course, that it displays aggressive behaviour vis-`a-vis the silicon. For example, it can be imagined that the fluid may be composed of a corrosive gas, the deleterious effects of which on silicon are nullified under these conditions. Moreover, the oxide layer can act as an electric insulation when the fluid conducts electricity.

OBJECTS OF THE INVENTION

It is an object of the invention to overcome the above-mentioned disadvantage of the prior art and to provide a process for the manufacture of micromachined devices of the type indicated hereinabove which makes it possible to guarantee a good bonding between the silicon body of the device and the glass closure plates while still conserving an oxide layer on the surfaces exposed to the fluid.

BRIEF SUMMARY OF THE INVENTION

It is thus an object of the invention to provide a process for the manufacture of a micromachined device adapted to contain or to convey liquid substances, this process consisting of:

machining a silicon plate by means of selective oxidation and photolithographic operations to form therein at least one cavity adapted to contain or to convey said fluid, and to oxidize the wall of said cavity to render it hydrophilic, and to complete said device by fixing closure plates to the body of the device thus formed, this process being characterised in that it consists in:

preceding said machining operations by covering the surfaces of said piece adapted to be in contact with said closure plates with a screening layer resistant to said machining operations;

after completing said machining operations, oxidizing the surfaces of said piece adapted to be exposed to said fluid to form therein an oxide layer favouring the wettability of these surfaces;

removing said screening layer; and fixing said closure plates to said piece.

BRIEF DESCRIPTION OF THE INVENTION

According to another feature of the invention, said screening layer is made of silicon nitride and deposited on said piece with interposition of an intermediate oxide layer.

According to another feature of the invention, said intermediate oxide layer has a thickness less than that of said oxide layer favouring the wettability, the process consisting inter alia, after removing said screening layer, in removing said intermediate oxide layer while said oxide layer favouring the wettability is exposed.

It is also a feature of the invention to provide a micromachined device obtained by the process such as defined hereinabove.

It emerges from these features that the assembly of the closure plates, which operation completes the micromachined device, remains easy to carry out with highly reliable results, whereas the silicon surfaces of the micromachined device adapted to come into contact with the fluid to be conveyed or stored, are hydrophilic and/or resistant to any aggression by this fluid.

BRIEF DESCRIPTION OF THE DRAWINGS

Other features and advantages of the instant invention will emerge from the following description given solely by way of example and made with reference to the appended drawings, in which.

DETAILED DESCRIPTION OF THE INVENTION

Figure 1A:
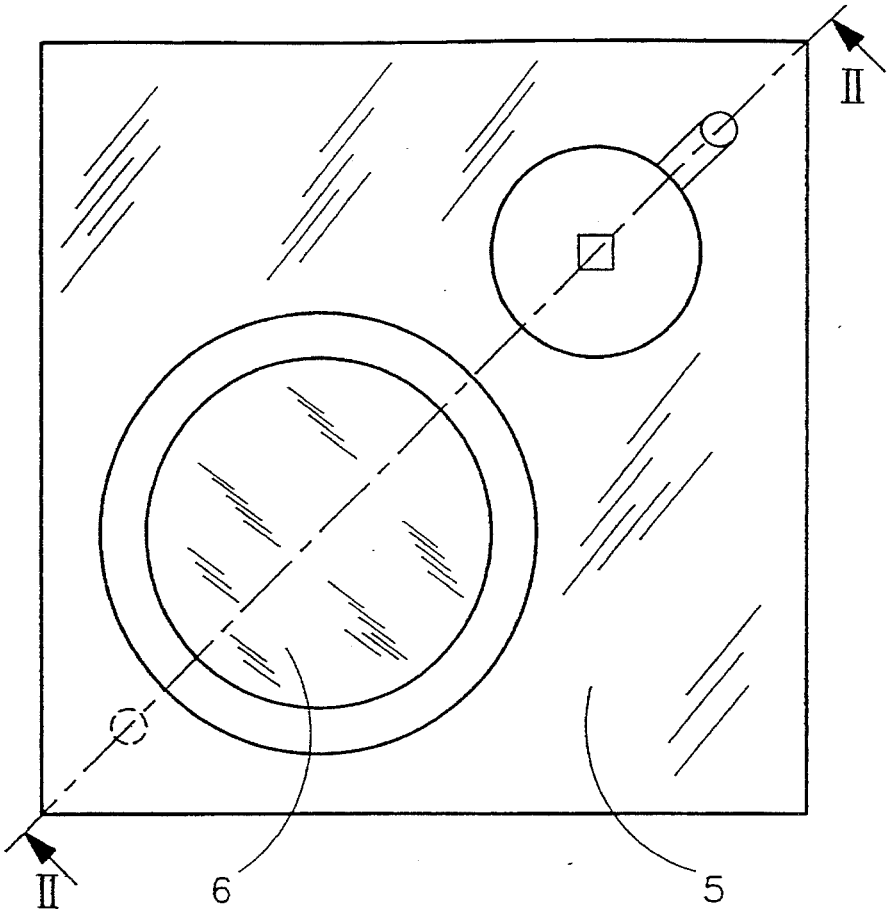
FIGS. 1*a* and 1*b* are diagrammatic plan views from above and below respectively, of an example of the micromachined device produced using the process of the invention, this example relating to a piezo-electrically driven micropump, the invention being, however, in no way limited thereto.
Figure 1B:
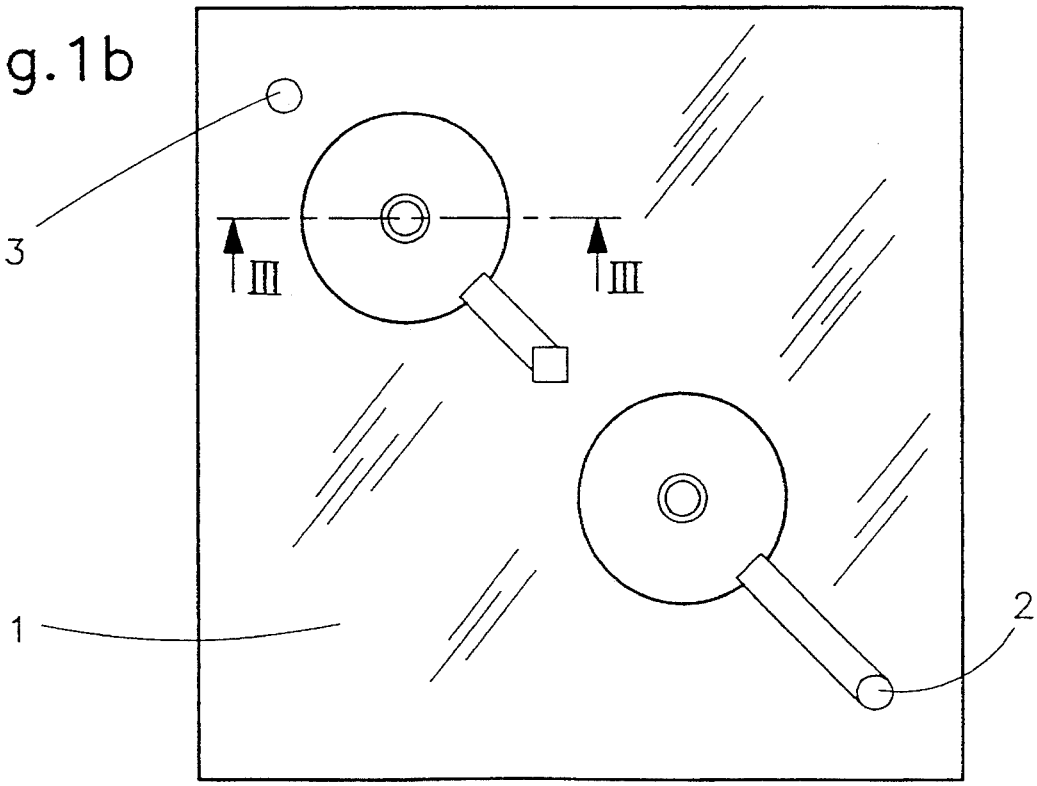
Figure 2:
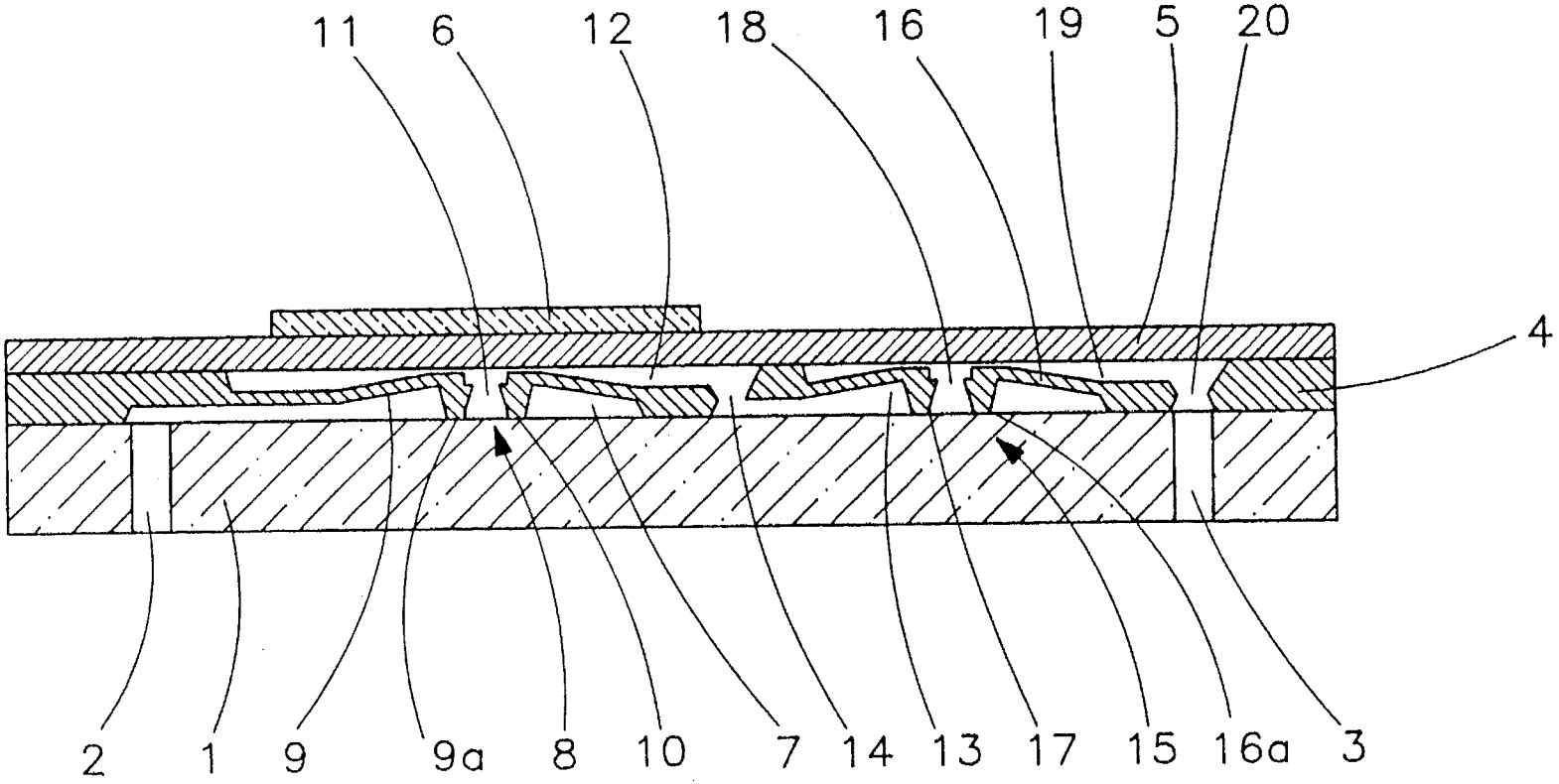
FIG. 2 is a transverse sectional view of the micropump shown in FIGS. 1*a* and 1*b*, said view being taken along the line II—II of these figures.

Reference will first be made to FIGS. 1*a*, 1*b* and 2 to describe by way of example the carrying out of the process of the invention, a piezo-electrically driven micropump, said object being particularly suitable for carrying out using this process. It will be noted that the terms "above" and "below" are only used for descriptive purposes, it being possible to use the pump in any spatial position.

The micropump has a base plate 1 or first closure plate, preferably made of glass and pierced through by two channels 2 and 3 which are, respectively, the inlet channel and the outlet channel of the micropump.

Fixed to this base plate 1 is a plate 4 forming the pump body and made of silicon, this plate being micromachined to form therein, by means of the process of the invention, the various active cavities and organs of the pump, as will be described below.

Fixed to a plate 4 forming the pump body is a third plate 5 that is relatively thin and preferably made of glass. This plate constitutes the second closure plate of the pump. Disposed thereon is a piezo-electric transducer 6 extending on one part of its outer surface, this transducer being designed, by virtue of its vibratory state induced when it is excited by an electric voltage, to deform the second closure plate 5 and then to vary the volume of the pumping chamber of the pump during its operation.

For sake of clarity and solely by way of example it may be noted that a micropump constructed in this manner has a general dimension of 22×22 mm, the thicknesses of the plates 1, 4 and 5 being 1.5 mm, 280 microns and 0.3 mm respectively.

The intermediate plate 4 forming the pump body constitutes an inlet chamber 7 (FIG. 2) communicating with the inlet channel 2 drilled in the base plate 1. This inlet chamber 7 surrounds an inlet valve 8, the gasket 9 of which is formed by a thin and deformable film machined in the silicon of the plate 4. The gasket 9 cooperates with a seating of the valve 10 which is not of a special material, but is formed by the corresponding part of the surface of the base plate 1 onto which the gasket 9 abuts. It will be noted that this gasket 9 has a ring-shaped seal 9*a* which is provided during the process of the invention and which is adapted to slightly bend the thin film and thereby guarantee good application of the gasket 9 to its seating 10.

The gasket 9 is provided with a central communicating hole 11 which opens, from the side of the film opposite the inlet chamber 7, into a pumping chamber 12 above which the piezo-electric transducer 6 is placed. It is thus the volume of this pumping chamber 12 which is caused to change periodically to achieve the pumping action of the micropump.

The pumping chamber 12 communicates with a transfer chamber 13 via the intermediary of a communicating orifice 14, this transfer chamber surrounding a second valve of the pump which is the outlet valve 15 thereof. This valve is constructed in substantially the same manner as the inlet valve and thus has a gasket 16, a gasket seal 16*a*, a seating 17 and a central communicating orifice 18. This latter connects, as appropriate, that is to say when the outlet valve 15 is open, the transfer chamber 13 with an outlet chamber 19 located above the outlet valve 15. This outlet chamber 19 communicates, in turn, with the outlet channel 3 of the pump via the intermediary of a communicating orifice 20.

The construction of the micropump that has just been described is known per se and no detailed operating description will therefore be given, particularly since this may easily be reconstructed from the following description of this construction.

The process of manufacturing the pump body 4 will now be described, emphasising the essential features of the instant invention which, as already indicated at the beginning of this text, are directed at improving the hydrophilic properties and resistance to the aggressivity of the fluids to be pumped of the surfaces of the pump body 4 in contact with this fluid during the operation of the pump.

FIGS. 3*a* to 3*j* represent diagramatically a partial sectional view of a pump body 4 taken along the line III—III of FIGS. 1*a* and 1*b* during various stages of the process of the invention. It should be noted that in the following description of the process the values of all parameters such as layer thicknesses, time spent in furnaces, etc. are only given by way of example and should not be considered as limiting to the instant invention.

A silicon piece 21, in which several pump bodies may be formed simultaneously using conventional technology, is first subjected to wet oxidation (stage of FIG. 3*a*) which forms an oxide layer 22 on the two surfaces thereof. The layer may be 1 micron thick and the process may be carried out in a furnace containing a water vapour atmosphere brought to a temperature of 1100° C. The water vapour may be created by a bubbler into which oxygen is introduced at a rate of 0.5 l/min and nitrogen at a rate of 4 l/min.

The sheet thereby provided with the oxide layers 22 is subjected to a conventional photolithographic operation involving attacking the oxide with fluorohydric acid buffered with ammonium fluoride in a ratio of 1:7 and at ambient temperature across a photoresistant mask so as only to retain the annular zones 23 adapted to subsequently form the seals 9*a* and 16*a* of the valves. (It should be noted that FIGS. 3*a* to 3*j* only show the zone corresponding to a single outlet valve 15).

Figure 3A:
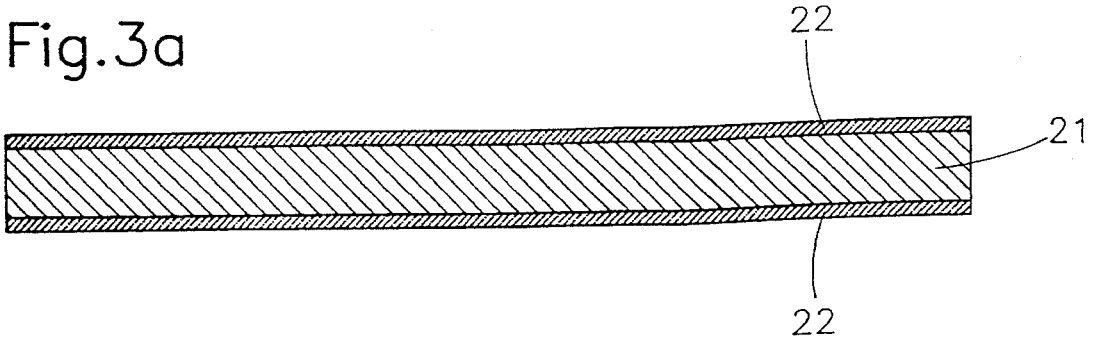
FIG. 3 shows, by a partially diagrammatic section along the line III—III of FIGS. 1*a* and 1*b*, the successive operations needed to carry out the process of the invention.
Figure 3B:
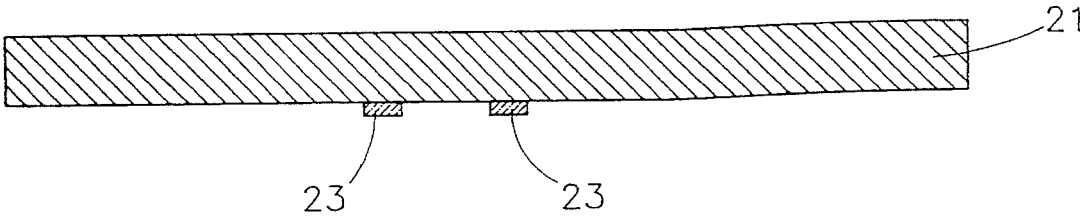
Figure 3C:
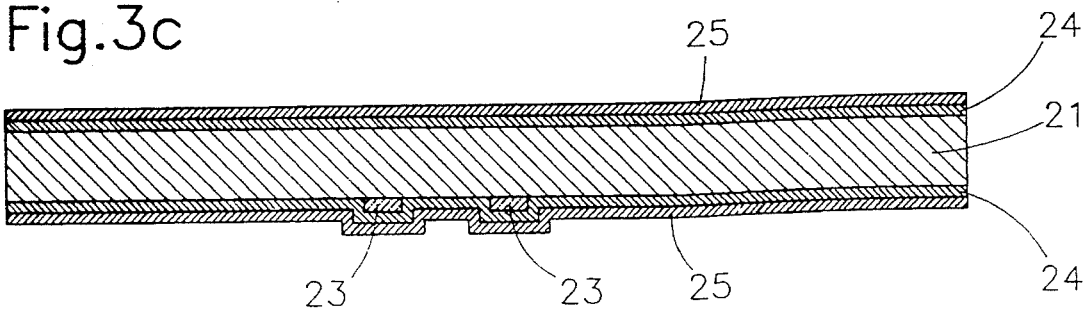

The piece resulting from the stage of FIG. 3*b* is then entirely covered with an oxide layer 24 of predetermined thickness (1000 Angströms in the example) by dry oxidation in a tubular furnace at 1100° C. in which a current of oxygen circulates at a rate of 2 l/min. The oxide layers thus obtained which act as a connecting layer, are covered in turn by a layer 25 of silicon nitride ($Si_3N_4$) by liquid phase chemical vapour deposition (LPCVD) at 800° C. and to a thickness of 1500 Angströms. According to one embodiment, the silicon nitride may be replaced by the same thickness of aluminium oxide ($Al_2O_3$).

Figure 3D:
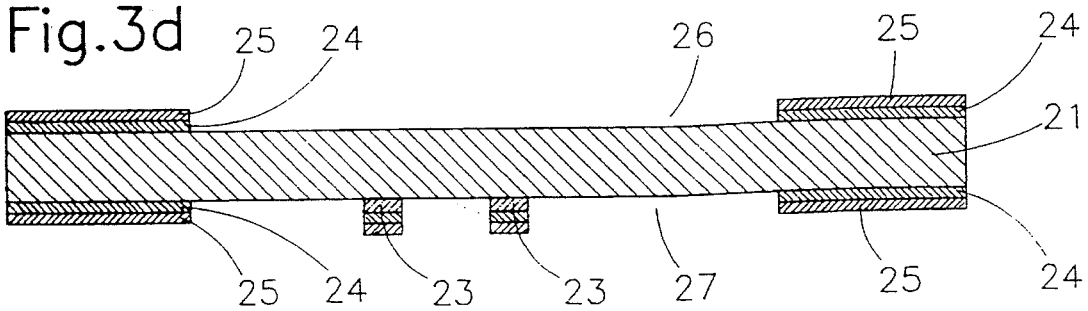

The following stage of the process, illustrated on FIG. 3*d*, consists in selectively removing the layers 24 and 25 to delimit the areas 26 and 27 on the piece in which the various cavities of the pump will subsequently be formed. As regards FIGS. 3*a* to 3*j*, these relate respectively to the outlet chamber 19 and to the transfer chamber 13. The annular zones corresponding respectively to the seals 9*a* and 16*a* are preserved. This stage thus comprises a conventional photolithographic operation by means of a photoresist during which the silicon nitride is first selectively removed by plasma attack and then the oxide by attack with buffered fluorohydric acid.

Figure 3E:
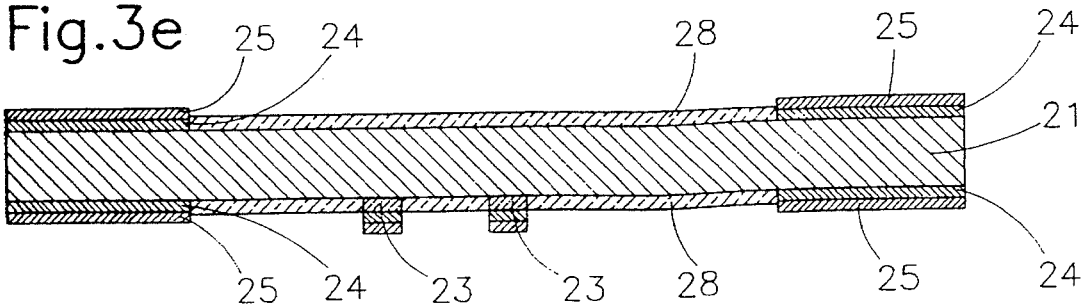
Figure 3F:
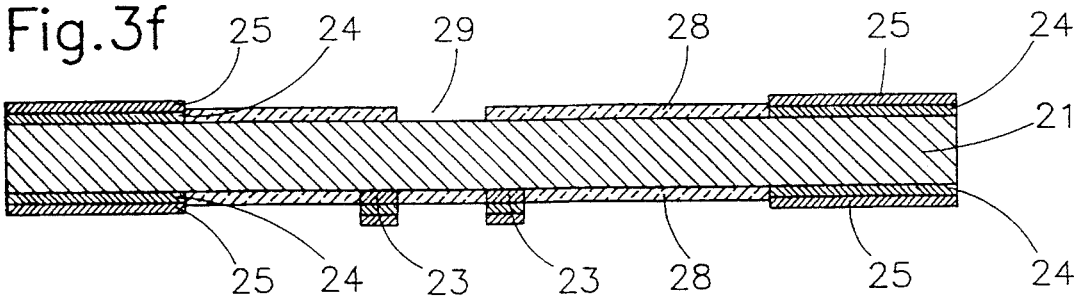
Figure 3G:
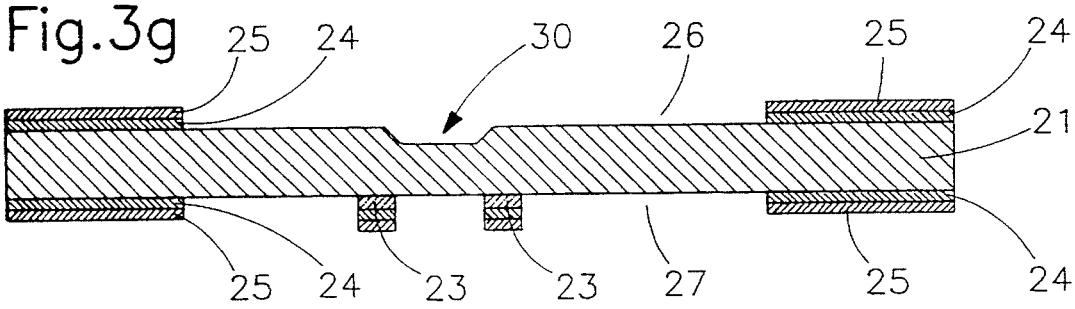

The piece 21 is then again subjected to an oxidation operation on its two faces outside the zones already covered by the silicon nitride to form the layers 28 (see FIG. 3*e*). This oxidation is effected in the same way as that which formed the layers 22 (see FIG. 3*a*), the thickness of the layers 28 being, for example, 3000 Angströms.

A circular opening 29 is then provided in the oxide layer 28 at the points where the central passages of the valves 8 and 15 must be located. This opening is provided by subjecting the piece to photolithographic operations by means of a photoresist, the attack itself being effected using buffered fluorohydric acid. This results in the configuration shown in FIG. 3*f*.

A cavity 30 is then made in the silicon by subjecting the piece to a solution of KOH at a temperature between 40° and 60° C. to attack it in anisotropic manner until the depth of the cavity is approximately equal to 50 microns, after which the residual, as yet not removed, oxide is removed by KOH attack, by again subjecting the piece to a solution of fluorohydric acid buffered with ammonium fluoride in a ratio of 1:7 and at ambient temperature until all the oxide has disappeared on both faces of the piece. This operation leads to the configuration shown in FIG. 3*g*.

Figure 3H:
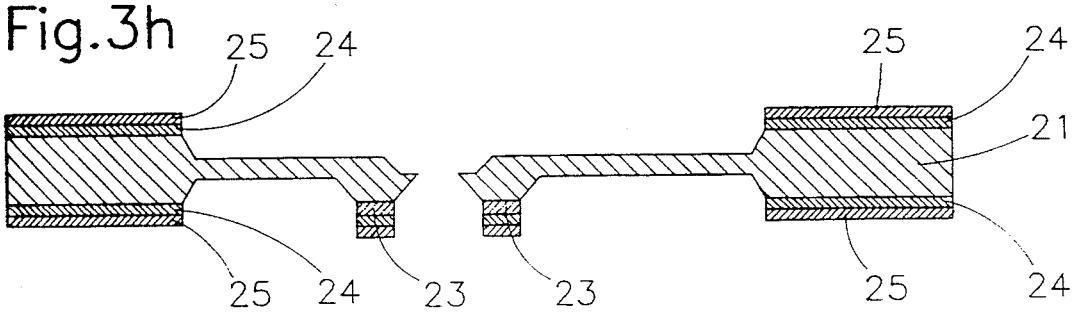

The piece is then again subjected to anisotropic attack with KOH by dipping in a solution of this compound for sufficient time so that what has become the body of each valve is no more than 50 microns thick. This operation also leads to the piercing of the piece at the centre of the valve and to the formation of the various cavities provided for the pump, as shown in FIG. 3*h*.

Figure 3I:
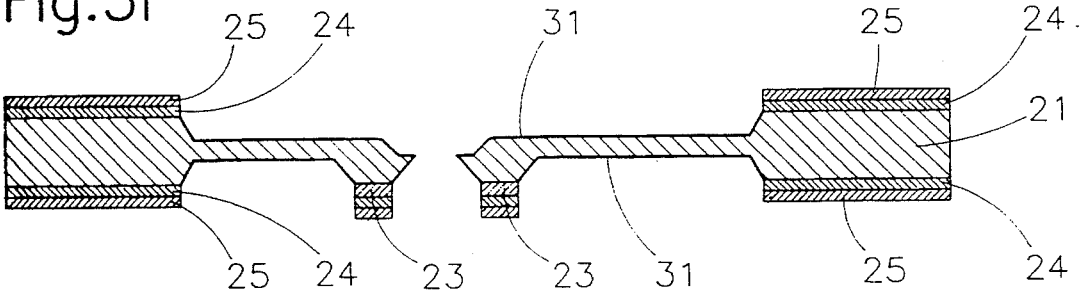
Figure 3J:
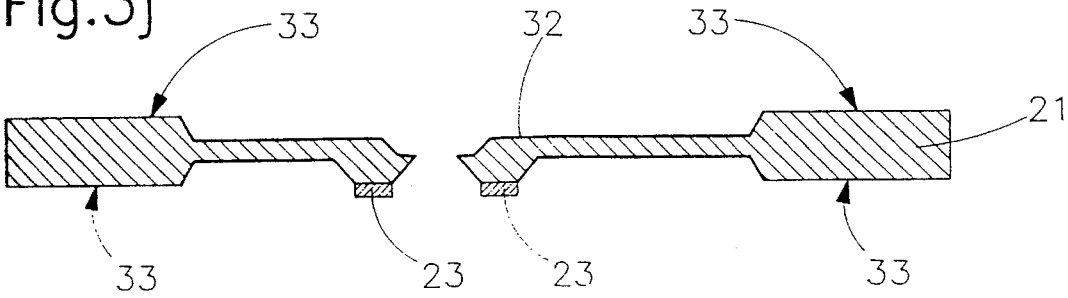

The piece is then subjected to wet oxidation under the same conditions as those which led to formation of the layer 22 until an oxide layer 31 about 3000 Angströms thick is obtained, this layer covering with oxide all the areas of the pump intended to come into contact with the fluid. As shown in FIG. 3*i*, the zones which remained covered with silicon nitride during all the stages of the process that have just been described are not affected by this oxidation operation.

The following stage of the process consists in eliminating the silicon nitride of the layer 25 still present on the piece by subjecting the latter to an 85% phosphoric acid solution at a temperature of about 180° C. and then to a solution of buffered fluorohydric acid solution to remove the oxide of the layer 24, previously underlying the silicon nitride. This latter operation also leads to the partial removal of the oxide layer 31. However, since the oxide layer 25 was about 1000 Angströms thick, the operation of removing the last formed oxide layer leaves sufficient thickness on the surfaces exposed to the fluid (about 2000 Angströms) for the surfaces to have sufficient wettability and to be sufficiently protected against any attack by this fluid. This last operation leads to the configuration shown in FIG. 3*j* which shows that one oxide layer 32 remains.

It will be noted that this configuration corresponds to the completed pump body to which it is then sufficient to fix the closing plates 1 and 5 by anodic welding and to position the piezo-electric transducer to complete construction of the micropump.

As will be noted, the hydrophilic and protection layer 32 is applied during the process of manufacturing the pump body without need for subsequent dipping operations capable of not only oxidizing the surfaces which really need to be oxidized, but also the surfaces 33 to which the closing plates of the pump have to be fixed, as was the case in the prior art.

Finally, the process of the invention makes it easy to obtain an oxide layer thicker than was the case in the prior art, which means that it also provides better electrical insulation.

We claim:

1. A process for manufacturing a micromachined device which is adapted to contain or convey a fluid and which comprises a body, having at least one cavity surrounded by hydrophilic oxidized surfaces for containing or conveying the fluid, and closure plates fixed to said body, said process comprising the following steps:

covering surfaces of a silicon plate, which are designed to be in contact with said closure plates, with an intermediate oxide layer and a screening layer which is resistant to machining operations;

machining the silicon plate by means of selective oxidation and photolithographic operations to form therein said cavity;

then, oxidizing said surfaces surrounding said cavity to form on said surfaces a second oxide layer which is thicker than said intermediate oxide layer;

removing said screening layer;

eliminating said intermediate oxide layer and partly removing said second oxide layer so as to leave only a final oxide layer which covers said surfaces and favors the wettability thereof; and fixing said closure plates to the body thus obtained.

2. A process according to claim 1, wherein said screening layer is made of silicon nitride.

3. A device produced by micromachining silicon and designed to contain or convey a fluid, said device being obtained according to the process as defined in claim 1.

* * * * *